US006385819B1

(12) United States Patent
Ingold

(10) Patent No.: US 6,385,819 B1
(45) Date of Patent: May 14, 2002

(54) SKI STRAP DEVICE

(76) Inventor: John P. Ingold, 1454 Limerick Ct., Green Bay, WI (US) 54313

( * ) Notice: Subject to any disclaimer, the term of this patent is extended or adjusted under 35 U.S.C. 154(b) by 0 days.

(21) Appl. No.: 09/706,366

(22) Filed: Nov. 3, 2000

(51) Int. Cl.[7] ..... A44B 11/00

(52) U.S. Cl. ..... 24/68 R; 24/198; 24/182; 280/821; 280/11.37 H; 2/60

(58) Field of Search ..... 24/68 R, 70 SK, 24/336, 198, 182, 132 R, 133, 170, 168, 305; 280/821, 822; 2/60, 160, 161.1, 162, 170, 271, 302, 309, 311, 312, 338

(56) References Cited

U.S. PATENT DOCUMENTS 3,808,645 A * 5/1974 Chow ..... 24/71 SK
3,923,317 A * 12/1975 Penney ..... 280/11.37 H
4,040,147 A * 8/1977 King ..... 24/86 A
4,082,303 A * 4/1978 Finnegan ..... 280/11.37 H
4,139,210 A * 2/1979 Allsop et al. ..... 280/11.37 H
4,162,081 A * 7/1979 Joseph ..... 280/11.37 H
4,572,464 A * 2/1986 Phillips ..... 248/1
4,887,318 A * 12/1989 Weinreb ..... 2/268
5,887,282 A * 3/1999 Lenhart ..... 2/159
6,076,848 A * 6/2000 Rigal et al. ..... 280/634
6,283,426 B1 * 9/2001 Guthrie et al. ..... 248/231.9

* cited by examiner

*Primary Examiner*—Chuck Y. Mah
*Assistant Examiner*—André L. Jackson
(74) *Attorney, Agent, or Firm*—Edward D. Gilhooly

(57) ABSTRACT

A device for enlarging the opening of the loop of a ski strap including a base being in bended contact with the ski strap while possessing rigidity for enlarging the opening. A plurality or retention strips are pivotally mounted on the base. The base includes openings for receiving male projections affixed to the retention strips such that the retention strips overlap the base in a locked relationship on the ski strap.

13 Claims, 2 Drawing Sheets

SKI STRAP DEVICE

BACKGROUND OF THE INVENTION

1. Field of the Invention

This invention relates in general to ski equipment and, more particularly, to a device for widening the opening of a ski strap.

2. Summary of the Prior Art

As is well known, ski poles are fitted with ski straps which hang downward in a looped configuration. The wrist strap on ski poles are commonly fabricated from flexible materials which tend to narrow the opening as the strap hangs downward from the pole. A skier ordinarily will insert his hands in and out of a ski strap on numerous occasions during the course of a ski session. The flattened opening of the ski strap can interfere with the convenient and safe insertion and withdrawal of the bulky gloved hand of the skier during the course of skiing. The difficulty involved in using known straps can diminish the enjoyment of the sport and is a particularly a problem for inexperienced and young skiers. Accordingly, it is desirable in skiing to provide a device by which the permanent size and width of the opening of the ski strap is optimized during skiing.

SUMMARY OF THE INVENTION

It is therefore an objective of the invention to provide a ski strap device for maintaining the loop of a ski strap in a more opened configuration for allowing a skier to easily insert and withdraw his gloved hand in and out of the strap. The invention herein employs a ski strap device which is capable of being permanently affixed in a convenient manner to any conventional ski strap. The material forming the device of the invention is bendable, but is more rigid than known ski straps formed from leather, nylon, and the like. The rigidity of the device herein disclosed insures that the strap is maintained in an opened configuration for the convenience of the skier when inserting or withdrawing his hands. The ski strap device of the application includes retention means which facilitates rapid attachment of the device to the ski strap with permanence and without interfering with the function of the ski strap itself during skiing. The device is inexpensive to manufacture and demonstrates an extended lifetime of use after being attached.

DESCRIPTION OF THE PREFERRED EMBODIMENTS

Figure 1:
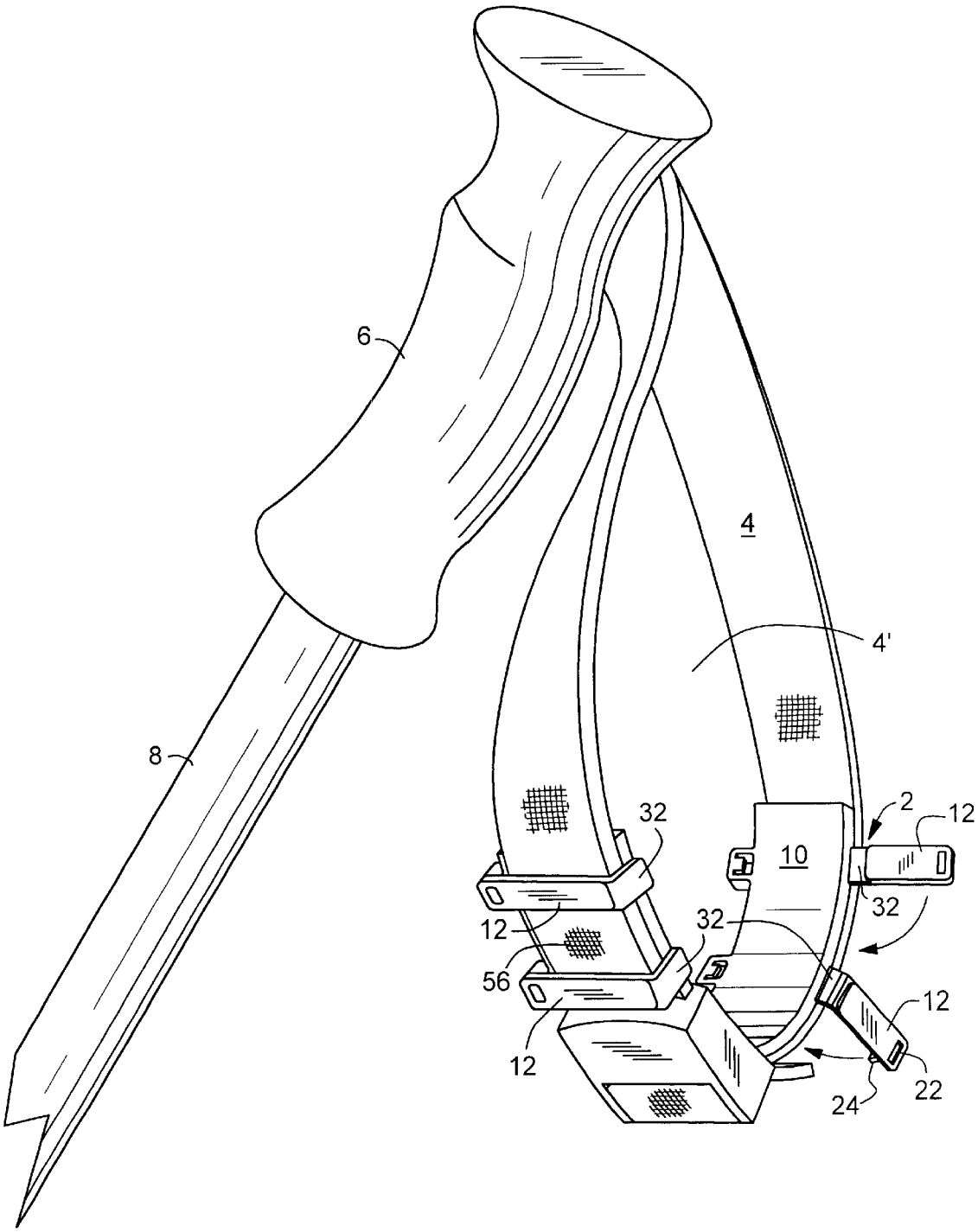
FIG. 1 is a side perspective view of a ski strap mounted on a ski pole and having the strap device of the invention.

Referring now to FIGS. 1 to 5, there is illustrated the ski strap device of the invention, generally designated by reference numeral 2. As seen in FIG. 1, the ski strap device 2 is intended to be attached to the loop of a ski strap 4 hanging from a grip 6 of a conventional ski pole 8. As is well known, ski straps are conventionally fabricated from a flexible material, such as, for example, leather, nylon, and the like. As will be apparent from the following description, the ski strap device 2 when attached to the ski strap 4 in accordance with the invention will establish an area of the increased rigidity for maintaining the opening 4' of the ski strap 4 in a wider opened configuration for ease of insertion and withdrawal of the gloved hand of a skier.

Figure 2:
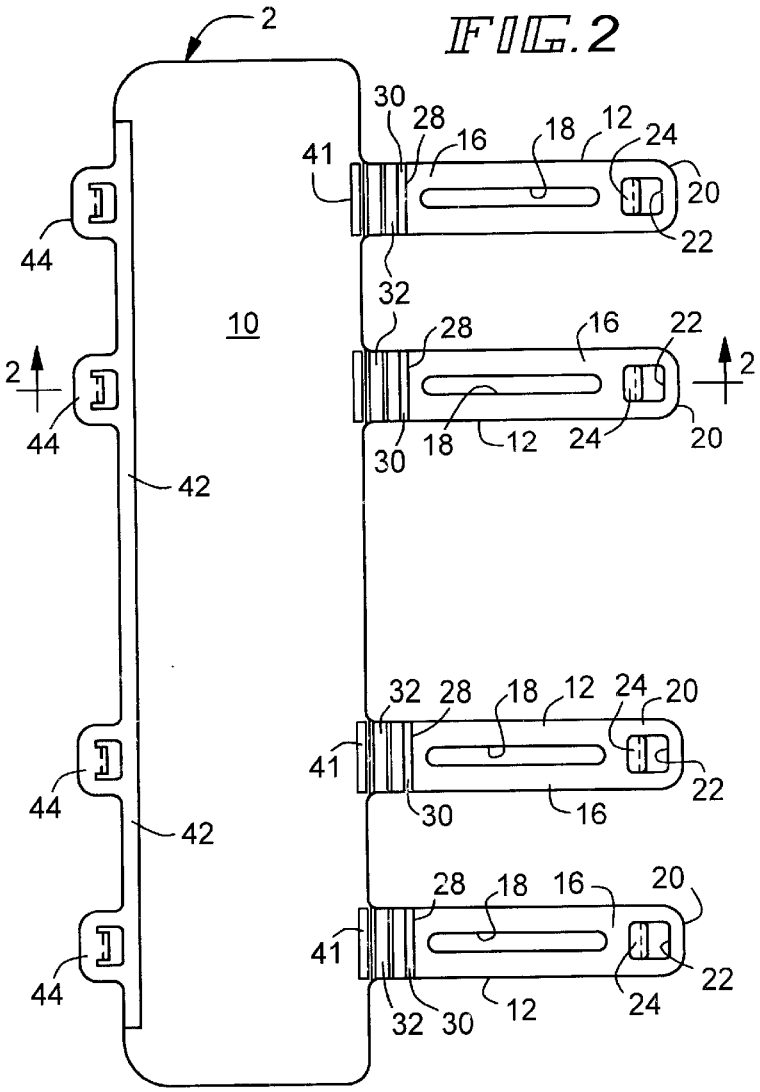
FIG. 2 is a top plan view of the ski strap device of the invention.

In FIGS. 2–5, the ski strap device 2 has a one-piece construction made from a molded plastic as illustrated or some other suitable material, such as a rubber or metal (not shown). The material of ski strap device is selected to have the flexibility to bend in conformance to the contour of the ski strap 6, but possess a greater rigidity than the material of strap 6 to cause the opening 4' to widen and maintain a permanent enlarged opening for insertion and withdrawal of the gloved hand of the skier. In its unattached shape shown in FIGS. 2–4, the ski strap device 2 includes a flexible base 10 having a generally flat configuration when unattached to ski strap 4. A plurality of outwardly extending, retention strips 12 are connected in spaced parallel relationship along one edge of flat base 10. Although four retention strips are shown in FIG. 2, it is within the scope of the invention to employ other numbers of retention strips 12, if desired.

Figure 3:
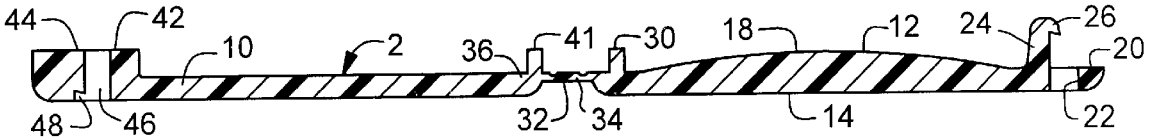
FIG. 3 is an end elevational sectional view taken along lines 3—3 of FIG. 2.
Figure 4:
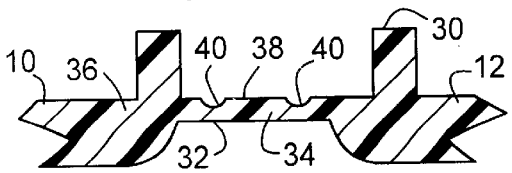
FIG. 4 is an enlarged partial view of the hinge portion ski strap device shown in FIG. 3.
Figure 5:
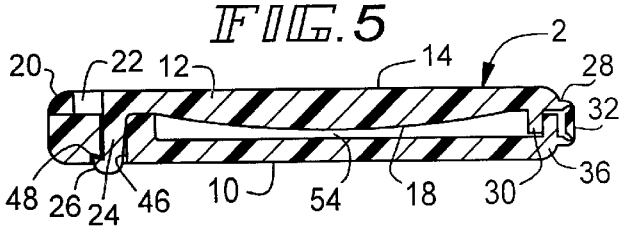
FIG. 5 is an end elevational view, with parts in section, of the ski strap device in a closed position when attached to a ski strap.

The retention strips 12 have a generally elongated, rectangular shape as seen in FIG. 2 with flat bottom faces 14 and generally flat upper faces 16 having partially domes areas 18. The outer ends 20 of the retention strips 12 are provided with openings 22. Male projections 24 having a hooked, offset end 26 are respectively formed on upper face 16 and are disposed adjacent openings 22. The inner end 28 of each retention strip 12 includes an upright wall 30 disposed adjacent a hinge 32 of the ski strap device 2. As seen in FIGS. 2 and 3, the hinge 32 is formed by a thin strip 34 connecting the inner end 28 of the retention strip 12 to the edge portion 36 of the base 10. A best seen in FIG. 3, the upper surface 38 of the thin strips 34 are provided with cut-out areas 40 to permit the retention strips 12 to be pivoted with ease into overlapping relationship with base 10 as shown in FIGS. 1 and 5.

A plurality of upright walls 41 are formed on base 10 immediately adjacent hinges 32. The opposite edge portion 42 to edge portion 36 of base 10 is formed as raised edge areas having an inner vertical wall 42' and four spaced locking pads 44. Each locking pad 44 has a longitudinal axis aligned with the longitudinal axis of a respective retention strip 12. The locking pads 42 have openings 46 to receive the male projection 24 of a respective retention strip 12 when inserted (FIG. 5). As seen in FIG. 3 and 5, the lower portion of opening 46 includes a notched area 48 which engages the hook end 26 of projection 24 and attaches the retention strip 12 to the locking pad 44 to permanently to secure device 2 to the ski strap 6. In its locked configuration in FIG. 5, the walls 30 of the retention strips 12 engage the inner surface of the upright walls 41 of the bases 10 for better strength and securement. As seen in FIG. 5, the secured retention strips 12 form an opening 54 with base 10 to permit the adjacent portion 56 (FIG. 1) of the ski strap 6 to be sandwiched between base 10 and a respective retention strip 12.

As further seen in FIG. 1, the device is attached by placing the base 10 on an inner surface of the ski strap 6. The base 10 assumes a curved shape in contact with the strap 6, but possesses rigidity to widen the opening 4' normally occurring in a conventional strap. Although the device 2 may be placed at other locations on the strap 6, the positioning of the base 10 adjacent the bottom of the strap loop as shown in FIG. 1 produces particular satisfactory results. The retention strips 12 are simply pivoted in the direction indicated by arrows in FIG. 1 to be locked as previously described. The convex portions of the retention strip aid in capture of the strap portion 56 between the retention strips 12 and base 10. The inner surface of base 10 is smooth and provides no obstruction or discomfort to the skier in use.

What is claimed is:

1. A device for expanding a size of a opening of a ski strap loop comprising a base having a generally flat configuration, said base being flexible to bend when in contact with the ski strap loop, said base possessing a rigidity sufficient to expand the size of the opening of the ski strap loop while said base is in contact with the ski strap loop, retention strip means being pivotally mounted on said base, said retention strip means being pivotal to be secured in overlapping relationship to said base with the ski strap being positioned between said base and said retention strip means.

2. The device according to claim 1 wherein said retention strip means includes a plurality of pivotally mounted retention strips for securement in overlapping relationship to said base.

3. The device according to claim 1 further including hinge means for securing said retention strip means to said base.

4. The device according to claim 3 wherein said hinge means includes a connecting strip of material.

5. The device according to claim 4 wherein said connecting strip of material includes cut out surface notches.

6. The device according to claim 2 wherein each of said plurality of retention strips includes a surface having a convex area for contacting the ski strap loop.

7. The device according to claim 2 wherein each of said retention strips includes a male projection for engaging said base in locking relationship.

8. The device according to claim 7 wherein said base includes a plurality of locking pads for receiving a respective one of said male projections of said plurality of retention strips to create a locking relationship.

9. The device according to claim 2 wherein said plurality of retention strips are pivotally connected to said base respectively by a plurality of hinges.

10. The device according to claim 9 wherein each of said retention strips includes a first vertical wall disposed adjacent a respective one of said plurality of hinges, said base includes a plurality of second vertical walls, said first vertical wall of said plurality of retention strips contacts a respective one of said plurality of second vertical walls in said overlapping relationship of said plurality of retention strips and said base.

11. The device according to claim 8 wherein said locking pads includes an opening for receiving said male projection of said plurality of retention straps in inserted relationship.

12. The device according to claim 11 wherein said male projection includes a hook-shaped end for engaging a portion of said locking pad for securement.

13. The device according to claim 12 wherein said portion is formed by a cut-out area in said pad.

* * * * *